US009169834B2

(12) United States Patent
Tobergte et al.

(10) Patent No.: US 9,169,834 B2
(45) Date of Patent: Oct. 27, 2015

(54) DISENGAGEABLE COOLANT PUMP FOR ENGINE

(71) Applicant: Ford Global Technologies, LLC, Dearborn, MI (US)

(72) Inventors: Michael Tobergte, Cologne (DE); Bert Pingen, Swisttal (DE); Bernd Schumacher, Langenfeld (DE); Jan Mehring, Cologne (DE); Kay Hohenboeken, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 84 days.

(21) Appl. No.: 13/912,093

(22) Filed: Jun. 6, 2013

(65) Prior Publication Data

US 2014/0017091 A1 Jan. 16, 2014

(30) Foreign Application Priority Data

Jul. 13, 2012 (DE) ..... 10 2012 212 325

(51) Int. Cl.
*F04B 17/05* (2006.01)
*F04D 13/02* (2006.01)
*F04D 15/00* (2006.01)

(52) U.S. Cl.
CPC ..... *F04B 17/05* (2013.01); *F04D 13/022* (2013.01); *F04D 15/0066* (2013.01)

(58) Field of Classification Search
CPC ... F04D 13/022; F16D 35/024; F16D 35/027; F16D 43/25; F16D 33/10; F16D 33/16
USPC ..... 192/58.7
See application file for complete search history.

(56) References Cited

U.S. PATENT DOCUMENTS

| | | | | |
|---|---|---|---|---|
| 3,174,600 | A * | 3/1965 | Oldberg | 192/58.682 |
| 4,650,045 | A | 3/1987 | Weible et al. | |
| 5,030,865 | A * | 7/1991 | Rockey et al. | 192/58.61 |
| 5,152,383 | A * | 10/1992 | Boyer et al. | 192/58.61 |
| 5,722,523 | A * | 3/1998 | Martin | 192/58.61 |
| 6,725,813 | B1 * | 4/2004 | Boyer | 123/41.44 |
| 7,891,178 | B2 | 2/2011 | Breese et al. | |
| 2010/0044602 | A1 * | 2/2010 | Boyer | 251/129.02 |

FOREIGN PATENT DOCUMENTS

| | | | |
|---|---|---|---|
| DE | 19533641 | A1 | 3/1997 |
| DE | 69800206 | T2 | 2/2001 |
| DE | 102010043264 | A1 | 5/2012 |

OTHER PUBLICATIONS

Schultheiss, Gerold et al., "Visco Cooler Pump—Demand Based Flow Rate Control,", MTZworldwide, vol. 3, pp. 226-231, 2012, (partial translation), 7 pages.

* cited by examiner

*Primary Examiner* — Rodney H Bonck
(74) *Attorney, Agent, or Firm* — Julia Voutyras; Alleman Hall McCoy Russell & Tuttle LLP

(57) ABSTRACT

A coolant pump includes a drive wheel, a driven wheel, and a coupling-control pump. The driven wheel is connected to a coolant impeller and coupled by a variable degree to the drive wheel, the degree of coupling responsive to an amount of fluid confined between the drive wheel and the driven wheel. The coupling-control pump is configured to change the amount of fluid confined between the drive wheel and the driven wheel based on a variable control signal.

19 Claims, 4 Drawing Sheets

DISENGAGEABLE COOLANT PUMP FOR ENGINE

CROSS REFERENCE TO RELATED APPLICATIONS

This patent application claims priority to German Patent Application DE 102012212325.3, filed Jul. 13, 2012, the entire contents of which are incorporated by reference herein, for all purposes.

TECHNICAL FIELD

This patent application relates to the field of motor-vehicle engineering, and more particularly, to a coolant pump for a motor-vehicle engine system.

BACKGROUND AND SUMMARY

A motor-vehicle engine system will typically include an engine-driven coolant pump (known also as a 'water pump'). The coolant pump circulates liquid coolant through jackets that surround the cylinder head or block of the engine to provide continuous cooling during engine operation. Recent coolant-pump configurations recognize the advantage of allowing the pumping rate—thus, the rate at which heat is carried away by the coolant—to vary with changing engine conditions. Specifically, after the engine has warmed to its normal operating temperature, it is desirable to operate the coolant pump in proportion to engine speed so that overheating is avoided and the normal operating temperature is maintained. When the engine is quite cool, however—e.g., following a cold start—cooling in proportion to engine speed may not be desirable. Instead, it may be desirable to allow the engine to warm to its normal operating temperature as quickly as possible. This strategy provides fuel-economy benefits deriving from faster viscosity reduction of the engine lubricant, which lowers friction, and faster warming of the intake air charge, which reduces pumping losses and increases EGR tolerance. Prompt engine warm-up also promotes faster catalyst light-off in the exhaust system, for improved emissions-control performance.

Accordingly, German patent application DE 10 2010 043 264 A1 describes an engine-driven coolant pump in which rotational motion from the crankshaft of the engine is transmitted through a fluid coupling to a coolant-pump impeller. In this design, the amount of torque transferred to the impeller is controlled based on the quantity of fluid confined within the fluid coupling at any point in time. This quantity can be changed in response to the cooling demand by opening one of two magnetically actuated valves situated in the coolant pump. Opening one valve allows the fluid to move out of the fluid coupling and into a storage chamber; opening the other valve allows the fluid to move back into the fluid coupling. In this approach, the less fluid within the coupling, the less torque is transferred to the impeller, and the less heat is carried away by the coolant.

The inventors herein have observed, however, that the fluid coupling of DE 10 2010 043 264 A1 cannot be drained completely of fluid under normal operating conditions. This is because the design relies on purely rotational forces to move the fluid out from the fluid coupling and into the storage chamber. As a result, the impeller is never completely decoupled from the spinning crankshaft: the pump continues to circulate coolant at a reduced rate even when no coolant flow is desired.

To address this issue and provide still other advantages, the present disclosure provides a coolant pump comprising a drive wheel, a driven wheel, and a coupling-control pump. The driven wheel is connected to a coolant impeller and coupled by a variable degree to the drive wheel, the degree of coupling responsive to an amount of fluid confined between the drive wheel and the driven wheel. The coupling-control pump is configured to change the amount of fluid confined between the drive wheel and the driven wheel based on a variable control signal. This configuration enables the drive wheel of the coolant pump to be completely decoupled from the driven wheel when minimum cooling is desired, for improved fuel economy and emissions-control performance.

The statements above are provided to introduce a selected part of this disclosure in simplified form, not to identify key or essential features. The claimed subject matter, defined by the claims, is limited neither to the content above nor to implementations that address the problems or disadvantages referenced herein.

DETAILED DESCRIPTION

Figure 1:
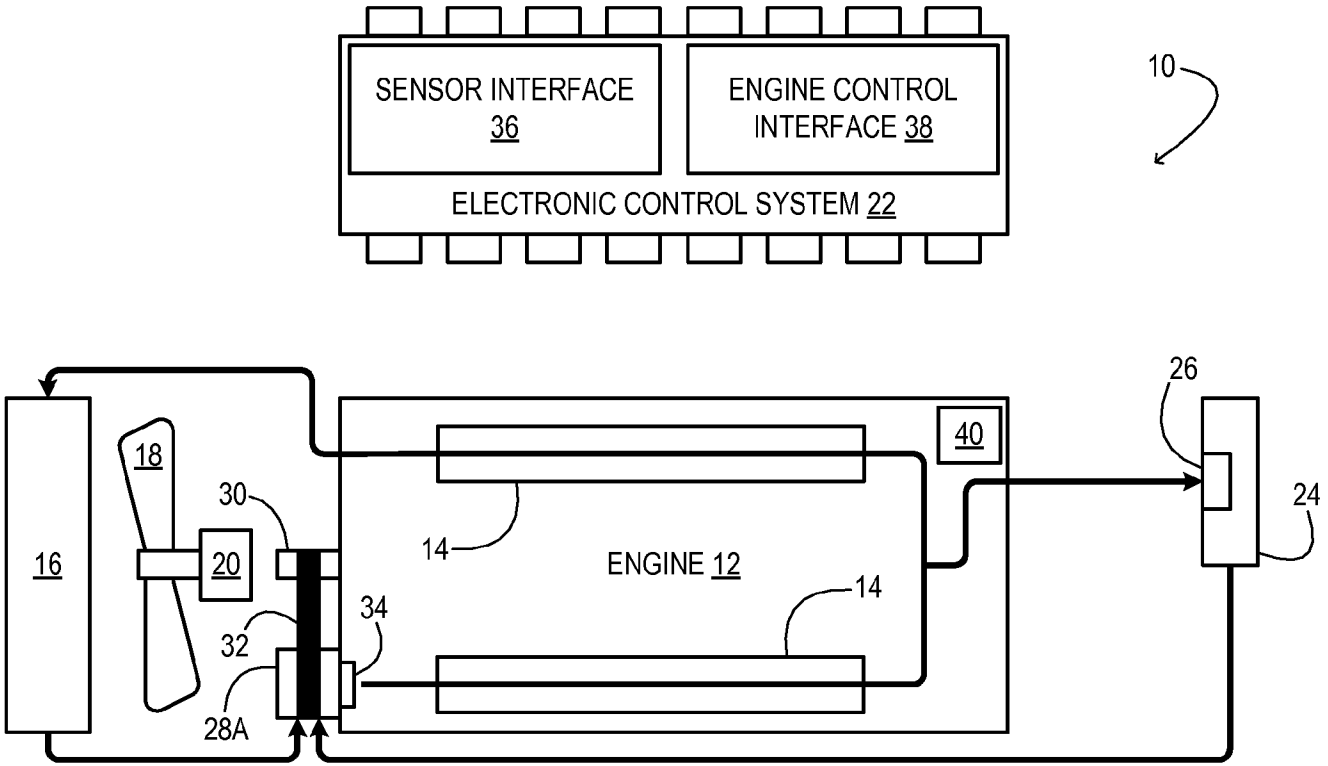
FIG. 1 shows aspects of an example engine system in accordance with an embodiment of this disclosure.

Aspects of this disclosure will now be described by example and with reference to the illustrated embodiments listed above. Components, process steps, and other elements that may be substantially the same in one or more embodiments are identified coordinately and are described with minimal repetition. It will be noted, however, that elements identified coordinately may also differ to some degree. It will be further noted that the drawing figures included in this disclosure are schematic and generally not drawn to scale. Rather, the various drawing scales, aspect ratios, and numbers of components shown in the figures may be purposely distorted to make certain features or relationships easier to see.

FIG. 1 shows aspects of an example engine system 10 in one embodiment. The engine system includes an engine 12, which inducts air, consumes fuel, and releases heat, exhaust, and mechanical energy. The engine may, for example, be a gasoline or diesel engine of a motor vehicle. Engine 12 includes one or more coolant jackets 14 configured to accommodate a flowing, liquid coolant. The coolant may comprise water mixed with one or more agents to suppress the freezing point, elevate the boiling point, and/or reduce corrosion of the components through which the coolant flows. The arrangement and configuration of the coolant jackets may differ in the different embodiments of this disclosure. In one example, a coolant jacket may surround or border a cylinder head of the engine. In other examples, one or more coolant jackets may surround or border a cylinder block of the engine. In these and other examples, additional coolant jackets may surround or border other engine components, such as an exhaust manifold or an intake manifold. Jackets configured to cool two or more engine components may be integrated together in some embodiments.

FIG. 1 shows a primary water-to-air heat exchanger 16, which is also called a 'radiator'. The primary heat exchanger includes a network of conduits with space between the conduits for air to flow through. Fan 18 is configured to draw air through the primary heat exchanger to cool the coolant therein. To this end, the fan is powered by electric motor 20 at a variable speed via an electronic control system 22. The electronic control system controls the electric current applied to the motor to achieve the desired level of cooling. FIG. 1 also shows a secondary water-to-air heat exchanger 24, which is also called a 'heater core'. The secondary heat exchanger includes a temperature-activated valve 26, which opens under selected conditions to enable the coolant to flow into the heater core to warm the cabin of the motor vehicle in which engine system 10 is installed.

FIG. 1 shows coolant pump 28, which is driven by crankshaft 30 through drive belt 32. In other embodiments, a drive gear or chain may couple the coolant pump to the crankshaft, or, the coolant pump may be coupled directly to the end of the crankshaft. The coolant pump includes a rotating impeller 34 situated inside engine 12 to promote the flow of coolant through coolant jackets 14. In the embodiments here contemplated, the degree of coupling between the crankshaft and the impeller is variable, controllably, via electronic control system 22. Accordingly, the impeller may receive significant torque from the crankshaft under certain operating conditions—e.g., when steady-state cooling is required—and much less torque under other conditions, such as during and after a cold start of the engine. Dedicated componentry of the coolant pump (vide infra) enables the amount of torque transferred from the crankshaft to the impeller to be varied.

Electronic control system 22 is configured to control and coordinate various engine-system functions. To this end, the electronic control system includes machine-readable storage media (i.e., memory) and one or more processors. Instructions coded into the machine-readable storage media enable decision making responsive to sensor input and directed to intelligent control of engine-system componentry. Such decision-making may be enacted according to various strategies: event-driven, interrupt-driven, multi-tasking, multi-threading, and the like. In this manner, the electronic control system may be configured to enact any or all aspects of the methods disclosed herein, wherein the various method steps—e.g., operations, functions, and acts—may be embodied as code programmed into the machine-readable storage media.

In the embodiment of FIG. 1, electronic control system 22 includes sensor interface 36 and engine-control interface 38. To assess operating conditions of engine system 10 and of the vehicle in which the engine system is installed, sensor interface 36 receives input from various sensors arranged in the vehicle—flow sensors, temperature sensors, pedal-position sensors, pressure sensors, etc. Engine-control interface 38 is configured to actuate electronically controllable valves, actuators, and other componentry of the vehicle. The engine-control interface is operatively coupled to each electronically controlled valve and actuator and is configured to command its opening, closure, and/or adjustment as needed to enact the control functions described herein.

Continuing in FIG. 1, in order to assess engine-system operating conditions and thereby determine the desired degree of coupling between crankshaft 30 and coolant-pump impeller 34, electronic control system 22 is operatively coupled to engine temperature sensor 40. When the electronic control system receives a signal from the engine temperature sensor that indicates a relatively high engine temperature, the electronic control system may increase the torque transmitted from the crankshaft to the coolant-pump impeller. Conversely, when the electronic control system receives a signal that indicates a relatively low engine temperature, the system may decrease the torque transmitted from the crankshaft to the coolant-pump impeller. In some embodiments, signal from the engine temperature sensor may also be used to determine the amount of electric current supplied to fan motor 20.

Figure 2:
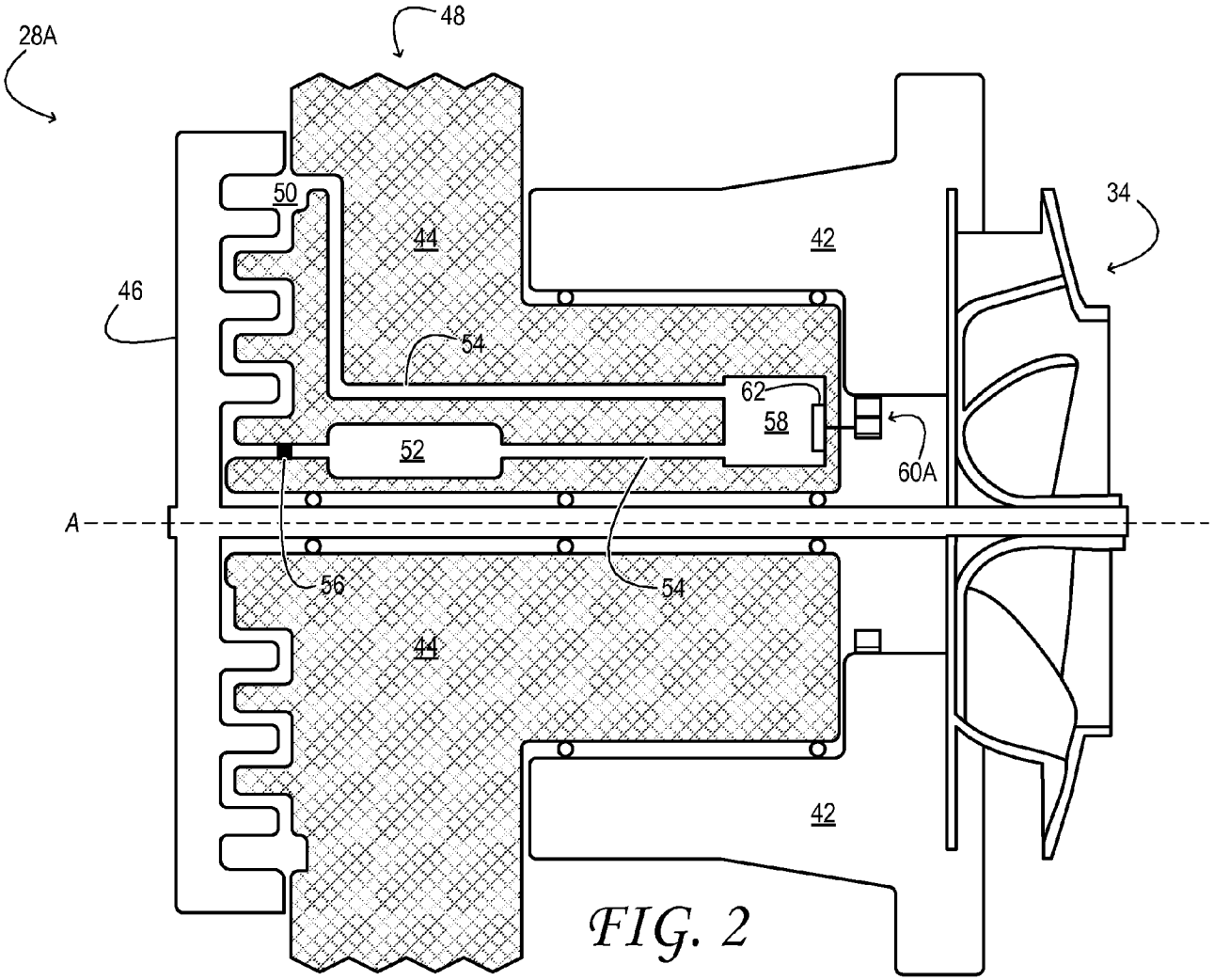
FIGS. 2 and 3 show aspects of example coolant pumps in accordance with embodiments of this disclosure.

FIG. 2 shows, in partial cross section, aspects of an example coolant pump 28A in one embodiment. In addition to impeller 34, the coolant pump includes stator 42, drive wheel 44, and driven wheel 46. In the embodiment shown in FIG. 1, the drive wheel is a pulley, which includes a grooved pulley track 48 configured to receive drive belt 32. The driven wheel is connected to the coolant impeller and coupled by a variable degree to the drive wheel. Here, the space between the drive wheel and the driven wheel is a so-called 'fluid coupling' or 'viscous-coupling'. Accordingly, the degree of kinematic coupling between the drive wheel and the driven wheel is responsive to the amount of fluid confined in this space. The fluid used to provide the variable coupling between the drive wheel and the driven wheel may be any suitable transmission oil, including a silicone oil.

Coolant pump 28 includes a shear chamber 50, in which the fluid between the drive wheel and the driven wheel is confined. The coolant pump also includes a storage chamber 52 for fluid not confined in the shear chamber, and a conduit 54 linking the shear chamber and the storage chamber. In the embodiment of FIG. 2, rotational forces from the drive wheel tend to move the fluid through the conduit in at least one direction. In the various embodiments of this disclosure, such rotational forces may include centrifugal forces from the drive wheel itself, or a combination of sheer and centrifugal forces brought about by the relative motion of the drive wheel with respect to the driven wheel, or with respect to the stator. To control the movement of the fluid under such forces, coolant pump 28 also includes a magnetically actuated valve 56 arranged in the conduit between the shear chamber and the storage chamber to selectably allow the fluid to flow between the shear chamber and the storage chamber, moved by the forces.

As shown in FIG. 2, coolant pump 28 also includes a coupling-control pump 58 arranged in conduit 54. The coupling-control pump is configured to change the amount of fluid confined between the drive wheel and the driven wheel based on a variable control signal. Such signal, which may include a continuously variable control signal, may originate from electronic control system 22. The signal may be a current, voltage and/or variable duty-cycle pulse train, for example. In the embodiment shown in FIG. 2, conduit 54, storage chamber 52, and coupling-control pump 58 are arranged inside drive wheel 44. The coupling-control pump may be a rotary-vane type pump with an eccentric cavity, in some examples.

In some embodiments, coupling-control pump 58 may be configured to pump the fluid through conduit 54 in a direction opposite the direction in which the rotational forces tend to move the fluid. In the embodiment of FIG. 2, for example, both the drive wheel and the driven wheel rotate about a common axis A. The centroid of shear chamber 50 lies farther from the axis than the centroid of storage chamber 52. Accordingly, centrifugal forces will tend to move the fluid from the storage chamber up into the shear chamber when magnetically actuated valve 56 is open. The coupling-control pump is therefore configured to pump the fluid in the opposite direction—i.e., back into the storage chamber. In some examples and under some operating conditions, the coupling-control pump may be configured to withdraw enough fluid from between the drive wheel and the driven wheel to substantially decouple the drive wheel from the driven wheel, resulting in little or no coolant flow when desired.

In the embodiment of FIG. 2, a mechanical transmission linkage 60A is arranged between coupling-control pump 58 and stator 42. Consisting of mated gears in the illustrated embodiment (or a pulley/belt system in other embodiments), the mechanical transmission linkage is configured to transmit rotational energy to the coupling-control pump in response to a rotation speed of the drive wheel. In this manner, increased fluid-pumping force becomes available at increased rotation speed—e.g., to counteract the increased centrifugal forces present at such speed. In this and other embodiments, the coupling-control pump may be coupled to the mechanical linkage by way of a magnetically actuated clutch 62. Electronic control system 22 may actuate the clutch to transmit power to the coupling-control pump under selected operating conditions, and to withhold power from the coupling-control pump under other operating conditions. In other embodiments, the clutch may be omitted, and the coupling control pump may receive power whenever the drive wheel is rotating.

Figure 3:
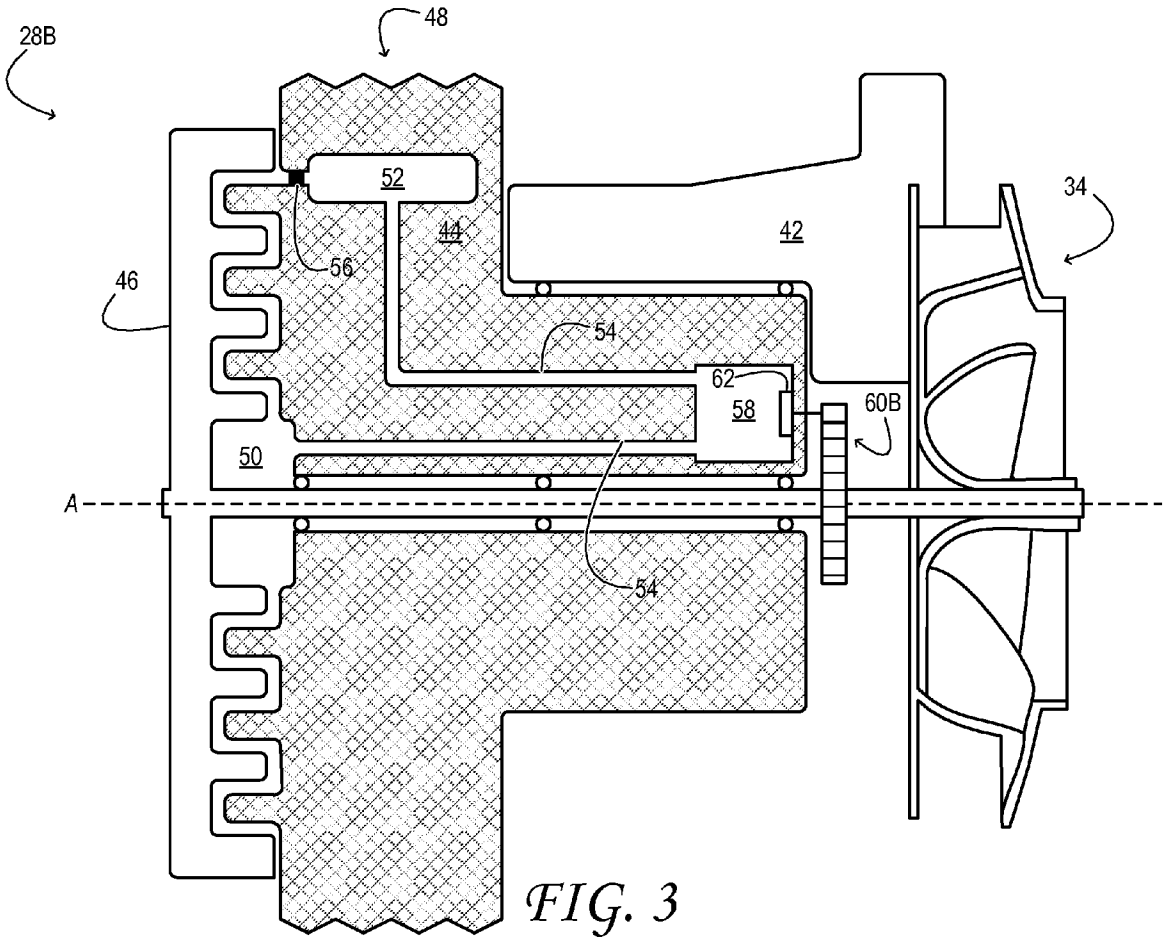

Despite the benefits afforded by the embodiment of FIG. 2, other configurations are contemplated as well. In the embodiment of FIG. 3, for instance, the centroid of storage chamber 52 lies farther from axis A than the centroid of shear chamber 50, so that rotational forces naturally move the fluid from the shear chamber to the storage chamber. Here, coupling-control pump 58 is configured to pump the fluid from the storage chamber to the shear chamber. In this embodiment, mechanical transmission linkage 60B is arranged between the coupling-control pump and driven wheel 46 and configured to transmit rotational energy to the coupling-control pump in response to the rotation speed difference between the drive wheel 44 and the driven wheel 46. This embodiment provides increased pumping action from the storage chamber to the shear chamber at increased slip, while the rotationally biased flow back into storage chamber increases with rotational speed. As in the previous embodiment, a magnetically actuated clutch 62 may be provided to selectably couple or decouple the coupling-control pump 58 and mechanical linkage 60B. In still other embodiments, the coupling-control pump may be an electrically powered pump configured to pump the fluid in opposite directions through conduit 54—i.e., from the storage chamber to the shear chamber and from the shear chamber to the storage chamber.

For ease of description, the direction of the rotationally biased fluid flow has been described as outward from axis A in the foregoing examples. However, the reader skilled in the art will appreciate that additional fluid-control componentry distributed in drive wheel 44 and/or any surface it rotates against may be configured to cause the fluid to flow in the opposite direction—i.e., towards axis A and the chamber disposed closest to the axis. In such embodiments, the coupling-control pump may be configured to pump the fluid from that chamber (shear chamber or storage chamber) to the other chamber farther from the axis. In general, any fluid flow biased by the rotation of the drive wheel may be controlled by a magnetically actuable valve disposed virtually anywhere in the conduit through which the fluid flows.

The configurations described above enable various methods for controlling a coolant pump of a motor-vehicle engine system. Accordingly, some such methods are now described, by way of example, with continued reference to the above configurations. It will be understood, however, that the methods here described, and others within the scope of this disclosure, may be enabled by different configurations as well. The methods may be entered upon any time the engine system is operating, and may be executed repeatedly. Naturally, each execution of a method may change the entry conditions for a subsequent execution and thereby invoke a complex decision-making logic. Such logic is fully contemplated in this disclosure. Further, some of the process steps described and/or illustrated herein may, in some embodiments, be omitted without departing from the scope of this disclosure. Likewise, the indicated sequence of the process steps may not always be required to achieve the intended results, but is provided for ease of illustration and description. One or more of the illustrated actions, functions, or operations may be performed repeatedly, depending on the particular strategy being used.

Figure 4:
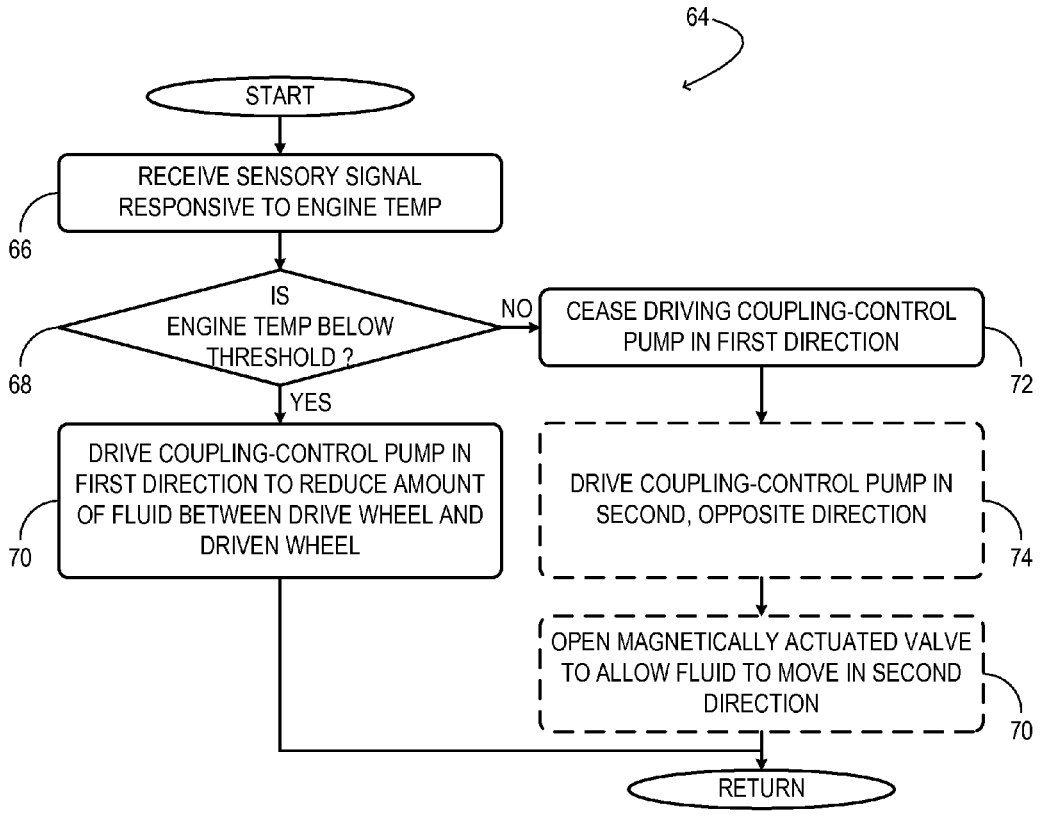
FIG. 4 illustrates an example method to control a coolant pump of a motor-vehicle engine system in accordance with an embodiment of this disclosure.

FIG. 4 illustrates an example method 64 to control a coolant pump of a motor-vehicle engine system. At 66 a sensory signal responsive to engine temperature is received in the electronic control system of the motor vehicle. At 68 it is determined whether the engine temperature is below a threshold. If the engine temperature is below the threshold, then the method advances to 70. At 70 a coupling-control pump of the coolant pump is driven in a first direction to reduce an amount of fluid confined between a drive wheel and a driven wheel of the coolant pump. However, if the engine temperature is not below the threshold, then the method advances to 72. At 72 the coupling-control pump ceases to be driven in the first direction, in order to increase the amount of fluid confined between the drive wheel and the driven wheel of the coolant pump. In some embodiments, an optional step 74 is enacted, wherein the coupling-control pump is driven in a second direction, opposite the first direction, to increase the amount of fluid confined between the drive wheel and the driven wheel of the coolant pump when engine temperature is above the threshold. In this and in other embodiments, a magnetically actuated valve arranged in the conduit may be opened. This action may be taken to increase the amount of fluid confined between the drive wheel and the driven wheel of the coolant pump when the engine temperature is above the threshold, for increased coolant flow.

In one embodiment, a method for a coolant pump comprising: rotating a drive wheel about an axis; adjusting a degree of coupling between a driven wheel connected to a coolant impeller the drive wheel, the degree of coupling responsive to an amount of fluid confined within a shear chamber between the drive wheel and the driven wheel; accommodating the fluid not confined in the shear chamber via a storage chamber; pumping the fluid between the shear chamber and the storage chamber via a coupling-control pump based on a variable control signal, where a conduit links the shear chamber, the storage chamber, and the coupling-control pump; and selectably allowing the fluid to flow between the shear chamber and the storage chamber moved by rotational forces from the drive wheel via a magnetically actuated valve arranged in the conduit.

No aspect of the above method should be understood in a limiting sense, for numerous variations and extensions are contemplated as well. For instance, although output from the temperature sensor is used above to control how much fluid is retained in the shear chamber of the coolant pump, other embodiments are envisaged in which such control is provided via a timing function, or, a combination of temperature and timing. In one particular example, the shear chamber may be evacuated to effectively null the impeller torque for a predetermined period of time (30 seconds, 90 seconds following engine start, etc.), provided that the measured engine temperature is below a threshold.

It will be understood that the articles, systems, and methods described hereinabove are embodiments of this disclosure—non-limiting examples for which numerous variations and extensions are contemplated as well. This disclosure also includes all novel and non-obvious combinations and subcombinations of the above articles, systems, and methods, and any and all equivalents thereof.

The invention claimed is:

1. A method to control a coolant pump of a motor-vehicle engine system, the method comprising:

when engine temperature is below a threshold, the threshold determined by an electronic control system, driving a coupling-control pump of the coolant pump in a first direction to reduce an amount of fluid confined between a drive wheel and a driven wheel of the coolant pump, the driven wheel connected to a coolant impeller and coupled by a variable degree to the drive wheel, the degree of coupling responsive to the amount of fluid confined between the drive wheel and the driven wheel;

when the engine temperature is above the threshold, ceasing to drive the coupling-control pump in the first direction to increase the amount of fluid confined between the drive wheel and the driven wheel of the coolant pump; and transmitting rotational energy to the coupling-control pump via a mechanical transmission linkage arranged between the coupling-control pump and the driven wheel in response to a rotation speed difference between the drive wheel and the driven wheel.

2. The method of claim 1 further comprising driving the coupling-control pump in a second direction opposite the first direction to increase the amount of fluid confined between the drive wheel and the driven wheel of the coolant pump when engine temperature is above the threshold.

3. The method of claim 1 wherein the coupling-control pump is an electrically powered pump, the method further comprising:

pumping the fluid via the coupling-control pump in opposite directions through a conduit linking a shear chamber and a storage chamber.

4. The method of claim 1, further comprising substantially decoupling the drive wheel from the driven wheel by withdrawing fluid from between the drive wheel and the driven wheel via the coupling-control pump in response to an engine temperature.

5. A method to control a coolant pump of a motor-vehicle engine system, the method comprising:

when engine temperature is below a threshold, the threshold determined by an electronic control system, driving a coupling-control pump of the coolant pump in a first direction to reduce an amount of fluid confined between a drive wheel and a driven wheel of the coolant pump, the driven wheel connected to a coolant impeller and coupled by a variable degree to the drive wheel, the degree of coupling responsive to the amount of fluid confined between the drive wheel and the driven wheel;

when the engine temperature is above the threshold, ceasing to drive the coupling-control pump in the first direction to increase the amount of fluid confined between the drive wheel and the driven wheel of the coolant pump; and transmitting rotational energy to the coupling-control pump via a mechanical transmission linkage arranged between the coupling-control pump and a stator of the coolant pump in response to a rotation speed of the drive wheel.

6. A method to control a coolant pump of a motor-vehicle engine system, the method comprising:

when engine temperature is below a threshold, the threshold determined by an electronic control system, driving a coupling-control pump of the coolant pump in a first direction to reduce an amount of fluid confined between a drive wheel and a driven wheel of the coolant pump, the driven wheel connected to a coolant impeller and coupled by a variable degree to the drive wheel, the degree of coupling responsive to the amount of fluid confined between the drive wheel and the driven wheel; and when the engine temperature is above the threshold, ceasing to drive the coupling-control pump in the first direction to increase the amount of fluid confined between the drive wheel and the driven wheel of the coolant pump, wherein the coupling-control pump is a rotary vane pump.

7. A method to control a coolant pump of a motor-vehicle engine system, the method comprising:

when engine temperature is below a threshold, driving a coupling-control pump of the coolant pump in a first direction to reduce an amount of fluid confined between a drive wheel and a driven wheel of the coolant pump, the driven wheel connected to a coolant impeller and coupled by a variable degree to the drive wheel, the degree of coupling responsive to the amount of fluid confined between the drive wheel and the driven wheel, wherein the fluid confined between the drive wheel and the driven wheel is confined within a shear chamber, the coolant pump further comprising a storage chamber configured to accommodate the fluid not confined within the shear chamber, and a conduit linking the shear chamber, the storage chamber, and the coupling-control pump;

when the engine temperature is above the threshold, ceasing to drive the coupling-control pump in the first direction to increase the amount of fluid confined between the drive wheel and the driven wheel of the coolant pump; and opening a magnetically actuated valve arranged in the conduit to increase the amount of fluid confined between the drive wheel and the driven wheel of the coolant pump when the engine temperature is above the threshold.

8. The method of claim 7 wherein the conduit, the storage chamber, and the coupling-control pump are arranged inside the drive wheel.

9. The method of claim 7 further comprising pumping the fluid through the conduit in the first direction via the coupling-control pump, and wherein rotational forces from the drive wheel move the fluid in a second direction opposite the first.

10. The method of claim 9 wherein the rotational forces include centrifugal forces.

11. The method of claim 10 further comprising opening the magnetically actuated valve arranged in the conduit to selectably allow the fluid to flow between the shear chamber and the storage chamber moved by the rotational forces.

12. The method of claim 7 further comprising rotating the drive wheel and the driven wheel about an axis, and wherein a centroid of the shear chamber lies farther from the axis than a centroid of the storage chamber.

13. The method of claim 7 further comprising rotating the drive wheel and the driven wheel about an axis, and wherein a centroid of the storage chamber lies farther from the axis than a centroid of the shear chamber.

14. The method of claim 7 further comprising driving the coupling-control pump in a second direction opposite the first direction to increase the amount of fluid confined between the drive wheel and the driven wheel of the coolant pump when engine temperature is above the threshold.

15. The method of claim 7 wherein the coupling-control pump is an electrically powered pump, the method further comprising:

pumping the fluid via the coupling-control pump in opposite directions through the conduit linking the shear chamber and the storage chamber.

16. The method of claim 7 further comprising transmitting rotational energy to the coupling-control pump via a mechanical transmission linkage arranged between the coupling-control pump and the driven wheel in response to a rotation speed difference between the drive wheel and the driven wheel.

17. The method of claim 7 further comprising transmitting rotational energy to the coupling-control pump via a mechanical transmission linkage arranged between the coupling-control pump and a stator of the coolant pump in response to a rotation speed of the drive wheel.

18. The method of claim 7 wherein the coupling-control pump is a rotary vane pump.

19. The method of claim 7, further comprising substantially decoupling the drive wheel from the driven wheel by withdrawing fluid from between the drive wheel and the driven wheel via the coupling-control pump in response to an engine temperature.

* * * * *